US005401339A

United States Patent [19]

Garg et al.

[11] Patent Number: 5,401,339

[45] Date of Patent: Mar. 28, 1995

[54] ATMOSPHERES FOR DECARBURIZE ANNEALING STEELS

[75] Inventors: Diwakar Garg, Macungie; Brian B. Bonner, Nesquehoning; Kerry R. Berger, Lehighton, all of Pa.

[73] Assignee: Air Products and Chemicals, Inc., Allentown, Pa.

[21] Appl. No.: 194,757

[22] Filed: Feb. 10, 1994

[51] Int. Cl.[6] ..... C21D 1/76

[52] U.S. Cl. ..... 148/629; 148/208; 148/633; 148/655; 148/660; 148/278; 148/287; 423/219

[58] Field of Search ..... 148/629, 633, 655, 660, 148/278, 287, 122, 208; 423/219

[56] References Cited

U.S. PATENT DOCUMENTS

| | | | |
|---|---|---|---|
| 3,535,074 | 10/1970 | Nakashima | 23/2 |
| 4,450,017 | 5/1984 | Berger et al. | 148/629 |
| 4,859,434 | 8/1989 | Roberts et al. | 423/219 |
| 4,931,070 | 6/1990 | Pasad | 55/16 |
| 5,057,164 | 10/1991 | Nilsson et al. | 148/633 |
| 5,069,728 | 12/1991 | Rancon et al. | 148/629 |
| 5,160,380 | 11/1992 | Vocke et al. | 148/206 |
| 5,221,369 | 6/1993 | Bowe et al. | 148/208 |
| 5,254,180 | 10/1993 | Bonner et al. | 148/208 |
| 5,259,893 | 11/1993 | Bonner et al. | 148/208 |
| 5,284,526 | 2/1994 | Garg et al. | 148/208 |
| 5,298,089 | 3/1994 | Bowe et al. | 148/208 |
| 5,298,090 | 3/1994 | Garg et al. | 148/208 |
| 5,302,213 | 4/1994 | Bonner et al. | 148/208 |
| 5,342,455 | 8/1994 | Bonner et al. | 148/208 |

FOREIGN PATENT DOCUMENTS

| | | |
|---|---|---|
| 45561 | 11/1988 | Australia . |
| 45562 | 11/1988 | Australia . |
| 86715 | 10/1991 | Australia . |
| 0404496 | 12/1990 | European Pat. Off. . |
| 2639249 | 11/1988 | France . |
| 2639251 | 11/1988 | France . |

OTHER PUBLICATIONS

Camet ® High Performance Catalytic Converters with Metal Cores, 4 pages, Camet Co. 1987.

Johnson Matthey, VOC destruction through catalytic incineration, 6 pages 1990.

Patrick Murzyn and Luis Flores, Jr., Carburizing with Membrane $N_2$: Process and quality issues, 1988, Heat treating Mar. pp. 281–32.

Harry Walton, New Method of Generating Nitrogen for Controlled Atmosphere Heat Treatment at Corrington Shiloh Plant, Mar. 1986, Industrial Heating, pp. 40–46.

P. F. Stratton, BOC Ltd., The Use of Non-Cryogenically Produced Nitrogen in Furnace Atmospheres, 1989, pp. 63–67 Heat Treatment of Metals.

*Primary Examiner*—Richard O. Dean
*Assistant Examiner*—Robert R. Koehler
*Attorney, Agent, or Firm*—Willard Jones, II

[57] ABSTRACT

A process for producing low-cost atmospheres suitable for decarburize annealing carbon steels from non-cryogenically generated nitrogen containing up to 1.54 residual oxygen by catalytically deoxygenating a non-cryogenically generated nitrogen stream at low temperatures with a hydrocarbon gas and mixing the deoxygenated stream with an economical amount of hydrogen prior to introduction into the furnace for annealing. The process includes the use of 1) hydrocarbon gas to convert residual oxygen to a mixture of carbon dioxide and moisture at low temperatures and 2) mixing the deoxygenated stream with a sufficient amount of hydrogen to maintain a $pH_2/pH_2O$ ratio of at least 2 in the furnace.

14 Claims, No Drawings

ATMOSPHERES FOR DECARBURIZE ANNEALING STEELS

FIELD OF THE INVENTION

The present invention pertains to creating furnace atmospheres for decarburize annealing carbon steels.

BACKGROUND OF THE INVENTION

Nitrogen-based atmospheres have been routinely used by the heat treating industry since the mid-seventies. For example, a mixture of humidified nitrogen and hydrogen has been extensively used for decarburize annealing low to medium carbon steels. U.S. Pat. No. 4,450,017 discloses using nitrogen gas mixed with carbon dioxide and hydrogen or with carbon dioxide and methanol for decarburize annealing carbon steels.

Carbon steel components are decarburize annealed to improve electrical and magnetic properties (such as to minimize hysteresis loses) or to facilitate machinability (such as drawing tubes or pipes in a die). The extent of surface decarburization depends on a number of factors including the concentration of moisture and/or carbon dioxide in the furnace atmosphere, the furnace operating temperature, the time the material is held at temperature, and whether the furnace atmosphere is oxidizing or reducing in nature. For example, the extent of surface decarburization will be limited, if the furnace atmosphere (more specifically the heating zone atmosphere) is oxidizing in nature. This is because oxidizing atmosphere promotes the formation of an oxide layer on the surface of the component which interferes with the diffusion of carbon from the interior to the atmosphere. The presence of reducing atmosphere, on the other hand, prevents the formation of an oxide layer on the surface and promotes surface decarburization. Finally, an increase in the furnace operating temperature has been known to enhance surface decarburization.

Therefore, carbon steel components are decarburize annealed in atmospheres that are reducing in nature both in the heating and cooling zones of continuous furnaces to obtain the desired decarburization depth and bright surface finish. On the contrary, if the decarburized components require an oxidized surface finish, they are annealed in atmospheres that are reducing in nature in the heating zone and oxidizing in nature in the cooling zone of continuous furnaces to obtain the desired decarburization depth. An oxidized surface finish is generally required to protect the surface of the components against atmospheric corrosion and to provide electrical insulating properties to the surface of the components. In any case, the furnace atmosphere needs to be reducing in nature at least in the heating zone, to allow moisture and/or carbon dioxide to decarburize anneal carbon steel components.

A major portion of nitrogen used for decarburize annealing carbon steels has been generated by distillation of air in large cryogenic plants. The cryogenically generated nitrogen is generally pure and expensive. To reduce the cost of nitrogen, several non-cryogenic air separation techniques such as adsorption and permeation have been recently developed and introduced in the market. Non-cryogenically generated nitrogen is less expensive for the user, but it contains 0.1 to 5% residual oxygen, making a direct substitution of cryogenically generated nitrogen with non-cryogenically generated nitrogen for decarburize annealing steels without scaling very difficult.

Non-cryogenically generated nitrogen has been successfully used to replace cryogenically generated nitrogen in applications where surface finish or appearance is not important and where a high concentration of furnace atmosphere reducing species facilitate conversion of residual oxygen in the non-cryogenically generated nitrogen to another form. For example, a mixture of non-cryogenically generated nitrogen and methanol has been commercially used today for carburizing steels in batch furnaces as well as continuous furnaces equipped with integrated quench cooling zones. Carburizing processes based on non-cryogenically generated nitrogen/methanol mixture have been described in detail in papers titled, "Carburizing with Membrane $N_2$: Process and Quality Issues", published in Heat Treating, pages 28–32, March 1988, "New Method of Generating Nitrogen for Controlled Atmosphere Heat Treatment at Torrington Shiloh Plant", published in Industrial Heating, pages 40–46, March 1986, and "The Use of Non-Cryogenically Produced Nitrogen in Furnace Atmospheres", published in Heat Treatment of Metals, pages 63–67, March 1989. The use of a non-cryogenically generated nitrogen/methanol mixture has, however, not been successful for decarburize annealing steels without scaling. Additionally, such atmospheres have not been successful for annealing parts in furnaces operated at temperatures below about 900° C.

Attempts have been made to use other reducing gases such as a hydrocarbon and hydrogen along with non-cryogenically generated nitrogen to produce atmospheres suitable for heat treating or annealing parts without scaling in furnaces but with limited success even with the use of an excess amount of a reducing gas. The problem has generally been related to scaling of the heat treated or annealed parts in the cooling and/or heating zones of the furnace. For example, methane has been added into the heating zone of continuous furnaces with non-cryogenically generated nitrogen in an attempt to produce atmospheres suitable for scale-free annealing of carbon steels. It was, however, not successful due to excessive oxidation of the parts, as described in a paper titled, "The Use of Non-Cryogenically Produced Nitrogen in Furnace Atmospheres", published in Heat Treatment of Metals, pages 63–67, March 1989. The oxidation problem was related to the slow rate of reaction between oxygen and methane at low temperatures and/or short residence times in continuous furnaces used for scale-free annealing. The above paper concluded that non-cryogenically generated nitrogen would be cost competitive to cryogenically produced nitrogen only at residual oxygen levels below about 0.2%, if at all possible.

Attempts have also been made to use hydrogen gas as a reducing agent with non-cryogenically generated nitrogen for scale-free, decarburize annealing of carbon steels in continuous furnaces. Unfortunately, the process required excessive amounts of hydrogen, making the use of non-cryogenically generated nitrogen economically unattractive.

U.S. Pat. No. 5,057,164 discloses and claims processes for producing an atmosphere suitable for heat treating metals from non-cryogenically generated nitrogen in continuous furnaces by reacting residual oxygen with hydrogen or carbon monoxide in the heating zone followed by extracting a part of the atmosphere from the heating zone and introducing it into the cooling zone of the furnace. Unfortunately, this process requires large amounts of hydrogen or carbon monoxide to provide a high $pH_2/pH_2O$ or $pCO/pCO_2$ ratio in the furnace, making it uneconomical for decarburize annealing steels.

Researchers have explored numerous alternative ways of using non-cryogenically generated nitrogen for heat treating metals in continuous furnaces. For example, furnace atmospheres suitable for decarburize annealing steels have been claimed to be generated from non-cryogenically generated nitrogen by converting residual oxygen to moisture with hydrogen gas in external units prior to feeding the resulting atmospheres into the furnaces. Such atmosphere generation methods have been disclosed in detail in U.S. Pat. No. 3,535,074, Australian Patent Application numbers AU45561/89 and AU45562/89 dated Nov. 24, 1988, and European Patent Application number 90306645.4 dated Jun. 19, 1990. Unfortunately, these processes are not cost-effective for decarburize annealing steels because they require large amounts of hydrogen to maintain the desired $pH_2/pH_2O$ ratio in the furnace.

U.S. Pat. No. 4,931,070 and French publication numbers 2,639,249 and 2,639,251 dated Nov. 24, 1988 discloses and claims producing atmospheres suitable for heat treating metals from non-cryogenically generated nitrogen by converting residual oxygen to moisture with hydrogen in external catalytic units followed by extraction of moisture prior to introducing atmospheres into furnaces. These methods are not cost effective because they require large amounts of hydrogen.

U.S. Pat. No. 5,069,728 discloses and claims producing atmospheres suitable for heat treating from non-cryogenically generated nitrogen by simultaneously introducing 1) non-cryogenically generated nitrogen along with hydrogen and carbon monoxide in the heating zone and 2) non-cryogenically generated nitrogen pre-treated to convert the residual oxygen to moisture with hydrogen in an external catalytic reactor or nitrogen gas free of oxygen in the cooling zone of a continuous furnace. Unfortunately, this method requires large amounts of hydrogen or carbon monoxide to maintain high $pH_2/pH_2O$ or $pCO/pCO_2$ ratio in the furnace, making it uneconomical for decarburize annealing steels.

U.S. Pat. No. 4,859,434 discloses and claims producing atmospheres suitable for heat treating from non-cryogenically generated nitrogen by reacting residual oxygen with vaporized methanol in an external catalytic reactor. This method has not been used in many parts of the world because of the costs involved in installing a methanol delivery system.

U.S. Pat. No. 5,160,380 discloses and claims a process for producing heat treating atmospheres by passing a mixture of air and a hydrocarbon gas through a catalyst retort heated to a temperature of about 800° C. The catalysts used in this patent are known to deactivate with time due to the use of high operating temperatures or coke deposition. The process is therefore not technically feasible for producing heat treating atmospheres for decarburize annealing carbon steels.

Australian patent application AU 86715/91 discloses a process for producing heat treating atmospheres by passing a mixture of non-cryogenically generated nitrogen and a hydrocarbon gas through a catalyst retort heated to a temperature above about 500° C. The catalysts used by patentees are also known to deactivate at high temperatures (above about 500° C) due to the formation of coke. The process is therefore not technically feasible for producing heat treating atmospheres for decarburize annealing carbon steels.

U.S. Pat. No. 5,221,369 discloses and claims producing atmosphere suitable for decarburize annealing steels from non-cryogenically generated nitrogen by reacting in-situ residual oxygen present in the non-cryogenically generated nitrogen with hydrogen. This method also requires large amounts of hydrogen to maintain high $pH_2/pH_2O$ in the furnace, making it uneconomical for decarburize annealing steels.

In many of the processes described above, atmospheres suitable for decarburize annealing of carbon steels are produced by converting residual oxygen present in the non-cryogenically generated nitrogen with hydrogen to moisture and adding sufficient amount of hydrogen to provide $pH_2/pH_2O$ ratio of at least 2 in the furnace. The residual oxygen is converted with hydrogen to moisture according to the following equation:

$$2H_2+O_2 \rightarrow 2H_2O$$

According to this equation, two moles (or parts) of hydrogen react with one mole (or part) of oxygen to yield two moles (or parts) of moisture. For example, 0.5 vol. % residual oxygen present in non-cryogenically generated nitrogen requires a minimum of 1.0 vol. % hydrogen (stoichiometric amount) to produce 1.0 vol. % moisture or nitrogen gas with approximately 45° F. dew point. Knowing the level of residual oxygen in the feed gas, one can easily calculate the stoichiometric amount of hydrogen and that required for producing the desired decarburize annealing atmospheres. These values were calculated and are summarized below:

| Residual Oxygen, % | Stoichiometric Amount of $H_2$, % | Decarburize Annealing Total $H_2$, % | D.P., °F. |
|---|---|---|---|
| 0.25 | 0.5 | 1.5 | 27 |
| 0.5 | 1.0 | 3.0 | 45 |
| 1.0 | 2.0 | 6.0 | 62 |
| 1.5 | 3.0 | 9.0 | 76 |

The total amount of hydrogen includes the amount of hydrogen required to convert residual oxygen to moisture plus the amount required to maintain reducing atmosphere in the heating zone of the furnace. One can see from the above table that the amount of hydrogen required for decarburize annealing steel increases with an increase in the residual oxygen content in the non-cryogenically generated nitrogen.

U.S. patent application Ser. No. 07/995,624 filed on Dec. 22, 1992, and assigned to Air Products and Chemicals, Inc., discloses and claims a process for producing atmospheres for decarburize annealing steels by deoxygenating non-cryogenically generated nitrogen with a hydrocarbon gas. Specifically, suitable atmospheres are produced by catalytically converting residual oxygen present in the non-cryogenically generated nitrogen at low temperatures with more than a stoichiometric amount of a hydrocarbon gas to a mixture of moisture and carbon dioxide followed by converting a portion of both moisture and carbon dioxide to hydrogen and carbon monoxide with an additional amount of a hydrocarbon gas in the heating zone of the furnace. The depth of decarburization obtained in these atmospheres is found to be limited either due to the presence of an oxidizing atmosphere or very low moisture and carbon dioxide levels in the heating zone of the furnace.

Therefore, since hydrogen is expensive, there is a need to produce atmospheres suitable for decarburize annealing atmospheres from non-cryogenically generated nitrogen while maximizing the extent of decarburization and minimizing the use of hydrogen.

SUMMARY OF THE INVENTION

This invention pertains to processes for producing low-cost atmospheres suitable for decarburize annealing carbon steels from non-cryogenically generated nitrogen. According to the invention, suitable atmospheres are produced by catalytically deoxygenating a non-cryogenically generated nitrogen stream containing up to 1.5% residual oxygen at low temperatures with a hydrocarbon gas and mixing the deoxygenated stream with an economical amount of hydrogen prior to introducing it into the furnace for annealing.

According to the invention, low and high carbon steels are decarburize annealed in a furnace operated at or above 700° C. using an atmosphere produced by 1) pre-heating non-cryogenically generated nitrogen stream containing up to 1.5% residual oxygen to a desired temperature, 2) mixing it with a controlled amount of a hydrocarbon gas, 3) passing it through a reactor packed with a platinum group of metal catalyst to reduce the residual oxygen to very low levels and to convert it to a mixture of moisture and carbon dioxide, and 4) mixing the reactor effluent with a minimum amount of expensive hydrogen to maintain a $pH_2/pH_2O$ ratio of at least 2 in the furnace and using it for annealing.

DETAILED DESCRIPTION OF THE INVENTION

According to the present invention, a process for producing low-cost atmospheres suitable for decarburize annealing carbon steels in furnaces from non-cryogenically generated nitrogen is based on the surprising discovery that such atmospheres can be produced by 1) pre-heating the non-cryogenically generated nitrogen stream containing residual oxygen to a desired temperature, 2) mixing it with a controlled amount of a hydrocarbon gas such as natural gas or propane, 3) flowing the mixture through a catalytic reactor to convert residual oxygen to a mixture of moisture and carbon dioxide, and 4) mixing the reactor effluent with an economical amount of hydrogen and using the resultant atmospheres for annealing.

Nitrogen gas generated by cryogenic distillation of air has been widely employed in many heat treating applications. Cryogenically generated nitrogen is substantially free of oxygen (oxygen content has generally been less than 10 ppm) and expensive. Therefore, there has been a great demand, especially by the heat treating industry, to generate nitrogen inexpensively for heat treating applications. With the advent of non-cryogenic technologies for air separation such as adsorption and permeation, it is now possible to generate nitrogen gas inexpensively. The non-cryogenically generated nitrogen, however, is contaminated with up to 5% residual oxygen, which is generally undesirable for bright annealing steels. The presence of residual oxygen has made the direct substitution of cryogenically generated nitrogen with that generated by non-cryogenic techniques very difficult.

The low-cost of non-cryogenically generated nitrogen has been the driving force behind extensive research work presently being carried out for finding alternative ways of utilizing it in a variety of heat treating applications. In fact, several attempts have been made to substitute cryogenically generated nitrogen with that generated non-cryogenically, but with limited success even with the addition of excess amounts of a reducing gas. The metallic parts treated with non-cryogenically generated nitrogen were always scaled or heavily oxidized. These problems are believed to be caused by the presence of unconverted oxygen in the furnace.

The problems related to unconverted oxygen can be resolved by converting residual oxygen to moisture with hydrogen or to a mixture of moisture and carbon dioxide with a hydrocarbon gas in an external catalytic reactor prior to introducing it into the furnace for heat treating. Since hydrogen is expensive, it is generally not economical to use hydrogen to produce atmospheres suitable for decarburize annealing from non-cryogenically generated nitrogen. Atmospheres suitable for decarburize annealing steels can be produced by deoxygenating non-cryogenically generated nitrogen with a hydrocarbon gas at low temperatures, as disclosed in the aforementioned U.S. patent application Ser. No. 07/995,624. Specifically, suitable atmospheres have been produced by catalytically converting residual oxygen present in the non-cryogenically generated nitrogen at low temperatures with more than a stoichiometric amount of hydrocarbon gas to a mixture of moisture and carbon dioxide followed by converting a portion of both moisture and carbon dioxide to hydrogen and carbon monoxide with an additional amount of a hydrocarbon gas in the heating zone of the furnace. The depth of decarburization or extent of decarburization achieved in these atmospheres has been found to be limited due to either the presence of an oxidizing atmosphere in the heating zone and/or the presence of very low moisture and carbon dioxide levels in the furnace. It is believed that the problems related to the limited depth or extent of decarburization can be overcome by maintaining reducing atmosphere as well as high moisture and carbon dioxide levels in the heating zone of the furnace.

According to the present invention, atmospheres suitable for decarburize annealing carbon steels are produced from non-cryogenically generated nitrogen by 1) converting residual oxygen present in the non-cryogenically generated nitrogen with an inexpensive hydrocarbon gas to a mixture of moisture and carbon dioxide in an external catalytic reactor and 2) mixing the reactor effluent stream with an economical amount of hydrogen to provide a $pH_2/pH_2O$ ratio of at least 2 in the furnace and using it for annealing.

The residual oxygen in non-cryogenically generated nitrogen for the process of the present invention can vary from 0.2% to about 2.0%. It can preferably vary from about 0.25% to about 1.5%. More preferably, it can vary from about 0.5% to about 1.0%.

The non-cryogenically generated nitrogen can be deoxygenated with a hydrocarbon gas at low temperatures using the process described in U.S. patent application Ser. No. 07/995,624, the specification of which is incorporated herein by reference. Specifically, the non-cryogenically generated nitrogen stream is pre-heated to a temperature ranging from about 200° to 400° C. and passed through a catalytic reactor to convert residual oxygen to a mixture of moisture and carbon dioxide. More preferably, the feed stream is pre-heated to a temperature varying from about 225° to about 350° C. The pre-heating temperature required depends on the reactivity and the nature of the hydrocarbon gas used. For example, the pre-heating temperature required with propane is considerably lower than the one required with methane or natural gas. Since the reaction between residual oxygen and a hydrocarbon gas is exothermic in nature, it is advisable to limit the pre-heating temperature to below about 400° C. to avoid the thermal cracking of the hydrocarbon gas and the deposition of coke on the catalyst. Instead of pre-heating feed gas, the catalytic reactor can be heated directly to the desired temperature.

The amount of a hydrocarbon gas used for converting residual oxygen to a mixture of moisture and carbon dioxide in the presence of a platinum group of metal catalyst is more than a stoichiometric amount needed for converting completely oxygen to a mixture of moisture and carbon dioxide. However, the amount of a hydrocarbon gas added is controlled in such a way that it minimizes the presence of unreacted hydrocarbon gas in the reactor effluent stream. The presence of too much unreacted hydrocarbon gas in the reactor effluent stream is undesirable because it interferes with the overall process of decarburizing steels. It is also advisable not to use too much hydrocarbon gas during catalytic deoxygenation to avoid the thermal cracking of the hydrocarbon gas and the deposition of coke on the catalyst. According to the disclosed process, it is preferable to limit the amount of a hydrocarbon gas required for converting residual oxygen to a mixture of moisture and carbon dioxide in an external catalytic reactor close to 2.5 times the stoichiometric amount or less.

The hydrocarbon gas can be selected from alkanes such as methane, ethane, propane, and butane and alkenes such as ethylene, propylene, and butene. Commercial feedstocks such as natural gas, petroleum gas, cooking gas, coke oven gas, and town gas can also be used as a hydrocarbon.

The catalytic reactor is packed with a precious metal catalyst supported on a high surface area support material made of alumina, magnesia, zirconia, silica, titania, or mixtures thereof. The precious metal catalyst can be selected from platinum group metals such as platinum, palladium, rhodium, ruthenium, iridium, osmium, or mixtures thereof. The metal concentration in the catalyst can vary from about 0.05 to about 1.0% by weight. Preferably, the metal concentration is between 0.2 to 0.5% by weight. Metal catalyst selected from palladium, platinum, or mixtures thereof supported on a high surface area alumina is more preferable. Metal catalyst can be shaped in the form of pellets or balls. Commercially available palladium and platinum metal based catalysts such as Type 30196-29 supplied by GPT, Inc., Manalapan, New Jersey, RO-20, R0-21, and RO-22 supplied by BASF Corporation, Parsippany, New Jersey, and Type 48, 50, 50A, 50B, 54, and 73 supplied by Johnson Matthey, Wayne, Pa. can also be used for deoxygenating nitrogen stream.

The precious metal catalyst can optionally be supported on a metallic or a ceramic honeycomb structure to avoid problems related to pressure drop through the reactor. Once again the precious metal catalyst supported on this structure can be selected from platinum group metals such as platinum, palladium, rhodium, ruthenium, iridium, osmium, or mixtures thereof. The cell density in the honeycomb structure can vary from about 100 to 400 cells per square inch. A cell density above about 200 cells per square inch is especially preferable. The metal concentration in the catalyst can vary from about 0.05 to about 1.0% by weight (or from about 10 to 30 mg precious metal per cubic foot of catalyst volume). Preferably, the catalyst is approximately from about 0.2 to 0.5 wt % palladium or a mixture of platinum and palladium in the metal form supported on honeycomb structure. The honeycomb structure can be similar to the one described in a technical brochure "VOC destruction through catalytic incineration" published by Johnson Matthey, Wayne, Pa. It can also be similar to the ones described in technical brochures "High Performance Catalytic Converters With Metal Cores" published by Camet Co., Hiram, Ohio and "Celcor (registered trade mark of Corning) Honeycomb Catalysts Support" published by Corning, N.Y.

The hourly flow rate of gaseous mixture flowing through the catalytic reactor can vary from about 100 to 50,000 times the volume of the reactor. It can preferably vary from about 1,000 to 20,000 times the volume of the reactor. More preferably, it can vary from about 2,000 to 10,000 times the volume of the reactor.

The effluent stream from the catalytic reactor containing a mixture of nitrogen, moisture, carbon dioxide, unreacted hydrocarbon gas, and less than 10 ppm residual oxygen is, as mentioned earlier, not suitable for decarburize annealing of carbon steels. It is therefore mixed with an economical amount of expensive hydrogen to provide a $pH_2/pH_2O$ ratio of at least 2 in the furnace and using it for annealing.

A continuous furnace with separate heating and cooling zones is most suitable for the process of the present invention. It can be operated at atmospheric or above atmospheric pressure for the process of the invention. The continuous furnace can be of a mesh belt, a shaker, a roller hearth, a pusher tray, a walking beam, or a rotary hearth type. A batch furnace is also suitable for the process of the present invention. The operating temperature of the heat treating furnace can be selected from about 700° C. and above.

The reactor effluent mixed with an economical amount of hydrogen can be introduced into the heating and cooling zones of a continuous furnace for decarburize annealing steels, if a bright surface finish is required. A part of the reactor effluent mixed with an economical amount of hydrogen can be introduced into the heating zone (to provide a reducing atmosphere) and the remaining part introduced into the cooling zone without the addition of hydrogen (to provide an oxidizing atmosphere) of a continuous furnace to decarburize annealing carbon steels, if an oxidized surface finish is required. Optionally, steam can be introduced along with the reactor effluent gas mixed with or without hydrogen added into the cooling zone of a continuous furnace, if an oxidized surface finish is required. The reactor effluent mixed with an economical amount of hydrogen can also be used during heating, annealing, and cooling cycles used for bright, decarburize annealing carbon steels parts in a batch furnace. Finally, the reactor effluent mixed with an economical amount of hydrogen can be used during heating and annealing cycles and the reactor effluent without the addition of hydrogen or with the addition of steam can be used during the cooling cycle for decarburize annealing carbon steels in a batch furnace, if an oxidized surface finish is required. The reactor effluent can optionally be used to pre-heat the gaseous feed mixture prior to introducing it into the catalytic reactor.

Low to high carbon or alloy steels that can be decarburize annealed according to the present invention can be selected from the groups 10XX, 11XX, 12XX, 13XX, 15XX, 40XX, 41XX, 43XX, 44XX, 47XX, 48XX, 50XX, 51XX, 61XX, 81XX, 86XX, 87XX, 88XX, 92XX, 92XX, 93XX, 50XXX, 51XXX, or 52XXX as described in Metals Handbook, Ninth Edition, Volume 4 Heat Treating, published by American Society for Metals.

According to the disclosed process, atmospheres suitable for decarburize annealing steels are produced from non-cryogenically generated nitrogen containing X vol. % residual oxygen by 1) converting residual oxygen to a mixture of moisture and carbon dioxide with X vol. % hydrocarbon gas in a catalytic reactor operated at low temperatures and 2) mixing the reactor effluent with 2X vol. % hydrogen to provide the desired $pH_2/pH_2O$ ratio of at least 2 in the furnace and using it for annealing steels. Thus, the amount of hydrogen required according to the present process to produce atmosphere suitable for decarburize annealing carbon steels from non-cryogenically generated nitrogen containing 1.0% residual oxygen will be 2.0% . On the contrary, the amount of hydrogen required for a pure hydrogen-based process to produced the desired decarburize annealing atmosphere from non.-cryogenically generated nitrogen containing 1.0% residual oxygen will be close to 6.0%. The present process, therefore, provides a net saving of close to 4.0% hydrogen over the conventional hydrogen-based process. Of course, the saving in hydrogen requirement will vary with the amount of residual oxygen present in the feed non-cryogenically generated nitrogen, as shown below.

| Residual Oxygen, % | Hydrogen Utilization, % Hydrogen-Based Process | Present Process | Saving in Amount of $H_2$, % |
|---|---|---|---|
| 0.25 | 1.5 | 0.50 | 1.00 |
| 0.5 | 3.0 | 1.00 | 2.00 |
| 1.0 | 6.0 | 2.00 | 4.00 |
| 1.5 | 9.0 | 3.00 | 6.00 |

The numbers in this table clearly show the advantages that can be realized by the present process over a pure hydrogen-based process.

The following examples are illustrative of the processes according to the invention. A 3" diameter reactor with 0.0736 $ft^3$ of catalyst was integrated with a Watkins-Johnson conveyor belt furnace, which is capable of operating at temperatures up to 1,150° C., and used to produce annealing atmospheres and to demonstrate the present process. The effluent stream from the catalytic reactor with and without the addition of hydrogen was introduced into the transition zone (a zone located between the heating and cooling zones) or heating zone of the furnace for annealing tests carried out at 750° C. and 850° C. The heating zone of the furnace consists of an 8.75 inches wide, about 4.9 inches high, and 86 inches long Inconel 601 muffle heated resistively from the outside. The cooling zone, made of stainless steel, is 8.75 inches wide, 3.5 inches high, and 90 inches long and was water cooled from the outside. A 8.25 inches wide flexible conveyor belt supported on the floor of the furnace was used to feed the samples to be annealed through the heating and cooling zones of the furnace. A fixed belt speed of 3 inches per minute was used in all the tests. Several 0.125 in. thick, 8 in. long, and 2 in. wide flat 1010 carbon steel and 0.015 in. thick electrical steel specimens were treated in these tests. The untreated electrical steel specimens contained approximately 0.018% carbon.

Control Example 1

Flat 1010 carbon steel and electrical steel specimens were annealed in a pure nitrogen-hydrogen atmosphere containing 10% hydrogen. The total nitrogen-hydrogen atmosphere flow rate of 350 SCFH was used for annealing specimens at 750° C. in the Watkins-Johnson furnace. The specimens annealed in this atmosphere had a bright surface finish. The cross-sectional analysis of the flat specimen showed a decarburization depth of less than 0.001 inch. The total carbon content of the electrical steel specimens was noted to decrease only from 0.018% to 0.016%.

This example therefore showed that a pure, dry nitrogen-hydrogen atmosphere can not be used effectively to decarburize anneal carbon steels.

Examples 2A, 2B, 2C, 2D and 2E, 3A, 3B, 3C, 3D and 3E summarized in Tables 1 and 2 illustrate processes for annealing carbon steels in atmosphere produced by deoxygenating non-cryogenically generated nitrogen with hydrogen.

TABLE I

| | Example 2A | Example 2B | Example 2C | Example 2D | Example 2E |
|---|---|---|---|---|---|
| Annealing Temperature, °C. | 750 | 750 | 750 | 750 | 750 |
| Type of Specimens | Carbon Steels | Carbon Steels | Carbon Steels | Carbon Steels | Carbon Steels |
| Feed Rate to Catalytic Reactor, SCFH | 350 | 350 | 350 | 350 | 350 |
| Feed Composition to Reactor | | | | | |
| Nitrogen, % | 99.9 | 99.8 | 99.5 | 99.0 | 98.5 |
| Oxygen, % | 0.1 | 0.2 | 0.5 | 1.0 | 1.5 |
| Hydrogen, *% | 10.0 | 10.0 | 10.0 | 10.0 | 10.0 |
| Feed Gas Composition to Furnace | | | | | |
| Oxygen, ppm | <5 | <5 | <5 | <5 | <5 |
| Hydrogen, % | 9.8 | 9.6 | 9.0 | 8.0 | 7.0 |
| Moisture, % | 0.2 | 0.4 | 1.0 | 2.0 | 3.0 |
| Nitrogen | Balance | Balance | Balance | Balance | Balance |
| $pH_2/pH_2O$ Ratio in Furnace Atmosphere | 49 | 24 | 9 | 4 | 2.33 |
| Quality of Treated Specimens | Bright | Bright | Bright | Bright | Light Gray Oxide |
| Flat Specimens Decarburization Depth, in. | 0.003-0.004 | 0.010 | 0.011 | 0.012 | 0.012 |
| Carbon Content in Treated | 0.016 | 0.0085 | 0.0065 | 0.006 | 0.006 |

TABLE I-continued

| | Example 2A | Example 2B | Example 2C | Example 2D | Example 2E |
|---|---|---|---|---|---|
| Electrical Steel Specimens, % | | | | | |

*Hydrogen was mixed with nitrogen and added as a percent oftotal non-cryogenically generated nitrogen

TABLE 2

| | Example 3A | Example 3B | Example 3C | Example 3D | Example 3E |
|---|---|---|---|---|---|
| Annealing Temperature, °C. | 750 | 750 | 750 | 750 | 750 |
| Type of Specimens | Carbon Steels | Carbon Steels | Carbon Steels | Carbon Steels | Carbon Steels |
| Feed Rate to Catalytic Reactor, SCFH | 350 | 350 | 350 | 350 | 350 |
| Feed Composition to Reactor | | | | | |
| Nitrogen, % | 99.5 | 99.5 | 99.5 | 99.0 | 99.0 |
| Oxygen,, % | 0.5 | 0.5 | 0.5 | 1.0 | 1.0 |
| Hydrogen, *% | 5.0 | 4.0 | 3.0 | 8.0 | 7.0 |
| Feed Gas Composition to Furnace | | | | | |
| Oxygen, ppm | <5 | <5 | <5 | <5 | <5 |
| Hydrogen, % | 4.0 | 3.0 | 2.0 | 6.0 | 5.0 |
| Moisture, % | 1.0 | 1.0 | 1.0 | 2.0 | 2.0 |
| Nitrogen | Balance | Balance | Balance | Balance | Balance |
| $pH_2/pH_2O$ Ratio in Furnace Atmosphere | 4 | 3 | 2 | 3 | 2.5 |
| Quality of Treated Specimens | Bright | Bright | Gray Oxide | Bright | Gray Oxide |
| Flat Specimens Decarburization Depth, in. | 0.012 | 0.012 | 0.011 | 0.012 | 0.011 |
| Carbon Content in Treated Electrical Steel Specimens, % | 0.006 | 0.006 | 0.007 | 0.006 | 0.007 |

*Hydrogen was mixed with nitrogen and added as a percent of total non-cryogenically generated nitrogen

Example 2A

A 350 SCFH of non-cryogenically generated nitrogen containing 0.1% residual oxygen was mixed with 10% hydrogen and deoxygenated by passing the mixture through a 3" diameter reactor packed with 0.5% platinum plus palladium metal catalyst supported on a metallic honeycomb structure with a cell density of 200 cells per square inch. The catalyst was supplied by Johnson Matthey of Wayne, Pa. The flow rate of gaseous mixture provided an hourly flow rate of gas stream through the reactor close to 4,750 times the volume of the reactor (Gas Hourly Space Velocity or GHSV of 4,750 1/h). The reactor effluent stream containing 9.8% hydrogen, 0.2% moisture, less than 5 ppm oxygen, and balance nitrogen was introduced into the heating or transition zone of the furnace operated at 750° C. to anneal steel specimens.

The steel specimens were annealed with a bright surface finish. The flat specimens showed a decarburization depth of 0.003–0.004 inch. The total carbon content of the electrical steel specimens decreased from 0.018% to only 0.016%. This example showed that the presence of 0.2% moisture in nitrogen-hydrogen atmosphere is not high enough to provide good decarburization.

Example 2B

The deoxygenation and annealing test described in Example 2A was repeated using the same flow rate and composition of feed gas with the exception of using non-cryogenically generated nitrogen containing 0.2% residual oxygen. The reactor effluent stream contained 9.6% hydrogen, 0.4% moisture, less than 5 ppm oxygen, and balance nitrogen.

The steel specimens were annealed with a bright surface finish due to the presence of a reducing atmosphere (or a $pH_2/pH_2O$ ratio greater than 3.0) both in the heating and cooling zones of the furnace. The flat specimens showed a decarburization depth of 0.010 inch. The total carbon content of the electrical steel specimens decreased from 0.018% to 0.0085%. This example showed that a moisture content of 0.4% in the atmosphere was effective in increasing decarburization.

Examples 2C and 2D

The deoxygenation and annealing test described in Example 2A was repeated twice with non-cryogenically generated nitrogen containing 0.5 and 1.0% residual oxygen, as shown in Table 1. The steel specimens were annealed with a bright surface finish due to the presence of a reducing atmosphere (or a $pH_2/pH_2O$ ratio greater than 3.0) in the heating and cooling zones of the furnace. The flat specimens showed a decarburization depth of 0.011–0.012 inch. The total carbon content of the electrical steel specimens was close to 0.006%. These examples showed that a moisture content greater than 0.4% in the nitrogen-hydrogen atmosphere is required to provide good decarburization.

Example 2E

The deoxygenation and annealing test described in Example 2A was repeated with non-cryogenically generated nitrogen containing 1.5% residual oxygen. The flat specimens showed a decarburization depth of 0.012 inch. The total carbon content of the electrical steel specimens was close to 0.006%. The steel specimens were annealed with a good depth of decarburization due to the presence of a reducing atmosphere (or a $pH_2/pH_2O$ ratio of at least 2) in the heating zone of the furnace. The specimens were, however, decarburize annealed with an oxide surface finish due to the presence of an oxidizing atmosphere (or a $pH_2/pH_2O$ ratio of less than 3.0) in the cooling zone of the furnace.

These examples therefore showed that increasing the moisture content beyond 2.0% does not appear to further increase decarburization of carbon steels. It showed that a reducing atmosphere (or a $pH_2/pH_2O$ ratio of at least 2) is required in the heating zone of the furnace to obtain good decarburization. Finally, it showed that the presence of an oxidizing atmosphere (or a $pH_2/pH_2O$ ratio of less than 3.0) in the cooling zone of the furnace will result in an oxide surface finish.

The above Examples showed that the presence of both a $pH_2/pH_2O$ ratio of at least 2.0 and a moisture level of at least 0.4% are required to provide good decarburization. Furthermore, they showed that a reducing atmosphere is required both in the heating and cooling zones of the furnace to obtain decarburize annealed specimens with a bright surface finish.

Example 3A

The deoxygenation and annealing test described in Example 2A was repeated using the same flow rate of non-cryogenically generated nitrogen with the exceptions of using nitrogen containing 0.5% residual oxygen and adding 5% hydrogen. The reactor effluent stream contained 4.0% hydrogen, 1.0% moisture, less than 5 ppm oxygen, and balance nitrogen.

The steel specimens were annealed with a bright surface finish due to the presence of a reducing atmosphere (or a $pH_2/pH_2O$ ratio greater than 3.0) in the heating and cooling zones of the furnace. The flat specimens showed a decarburization depth of 0.012 inch. The total carbon content of the electrical steel specimens decreased from 0.018% to 0.006%. This example showed that the presence of a moisture content of 1.0% and a $pH_2/pH_2O$ ratio greater than 2.0 in the heating zone of the furnace are desirable for decarburizing carbon steels.

Example 3B

The deoxygenation and annealing test described in Example 3A was repeated by using 4% hydrogen. The steel specimens were annealed with a bright surface finish due to the presence of a reducing atmosphere (or a $pH_2/pH_2O$ ratio of 3.0) in the heating and cooling zones of the furnace. The flat specimens showed a decarburization depth of 0.012 inch. The total carbon content of the electrical steel specimens was close to 0.006%. This example once again showed that the presence of a moisture content of 1.0% and a $pH_2/pH_2O$ ratio greater than 2.0 in the heating zone of the furnace are desirable for decarburizing carbon steels.

Example 3C

The deoxygenation and annealing test described in Example 3A was repeated by using 3% hydrogen. The steel specimens were annealed with an oxide surface finish due to the presence of an oxidizing atmosphere (or a $pH_2/pH_2O$ ratio of less than 3.0) in the cooling zone of the furnace. The flat specimens showed a decarburization depth of 0.011 inch and the total carbon content of the electrical steel specimens was close to 0.007%. This example once again showed that it is desirable to have a $pH_2/pH_2O$ ratio of at least 2.0 in the heating zone of the furnace while decarburize annealing carbon steels.

Example 3D

The deoxygenation and annealing test described in Example 2A was repeated using the same flow rate of non-cryogenically generated nitrogen with the exceptions of using nitrogen containing 1.0% residual oxygen and adding 8% hydrogen, as shown in Table 2. The reactor effluent stream contained 6.0% hydrogen, 2.0% moisture, less than 5 ppm oxygen, and balance nitrogen.

The steel specimens were annealed with a bright surface finish due to the presence of a reducing atmosphere (or a $pH_2/pH_2O$ ratio greater than 3.0) in the heating and cooling zones of the furnace. The flat specimens showed a decarburization depth of 0.012 inch. The total carbon content of the electrical steel specimens decreased from 0.018% to 0.006%. This example showed that the presence of moisture content and $pH_2/pH_2O$ ratio greater than 1.0 and 2.0, respectively, in the heating zone of the furnace are desirable for decarburize annealing carbon steels.

Example 3E

The deoxygenation and annealing test described in Example 3D was repeated by using 7% hydrogen. The steel specimens were annealed with an oxide surface finish due to the presence of an oxidizing atmosphere (or a $pH_2/pH_2O$ ratio of less than 3.0) in the cooling zone of the furnace. The flat specimens showed a decarburization depth of 0.011 inch and the total carbon content of the electrical steel specimens was close to 0.007%. This example showed that it is desirable to have to have a $pH_2/pH_2O$ ratio of at least 2.0 in the heating zone of the furnace while decarburize annealing carbon steels.

Table 3 summarizes a series of tests showing deoxygenation of noncryogenically generated nitrogen with a hydrocarbon gas.

TABLE 3

| | Example 4A | | Example 4B | | Example 4C | Example 4D |
|---|---|---|---|---|---|---|
| Flow Rate of Feed Gas, SCFH | 350 | 350 | 350 | 350 | 350 | 350 |
| Composition of Feed Gas | | | | | | |
| Nitrogen, % | 99.5 | 99.5 | 99.5 | 99.5 | 99.0 | 99.5 |
| Oxygen,, % | 0.5 | 0.5 | 0.5 | 0.5 | 1.0 | 0.5 |
| Catalyst Type | 0.5% Pd on Alumina Pellets | 0.5% Pt/Pd on Metallic Honeycomb | 0.5% Pd on Alumina Pellets | 0.5% Pt/Pd on Metallic Honecomb | 0.5% Pt/Pd on Metallic Honecomb | 0.5% Pt/Pd on Metallic Honecomb |
| GHSV, 1/h | 4,750 | 4,750 | 4,750 | 4,750 | 4,750 | 4,750 |
| Amount of Natural Gas Added, % | 0.25 | 0.25 | 0.50 | 0.50 | 1.0 | 1.00 |
| Feed Gas Temperature, °C. | 320 | 320 | 320 | 320 | 320 | 320 |
| Effluent Gas Oxygen Level, ppm | >1,000 | <1,000 | <5 | <5 | <5 | <5 |

Example 4A

A 350 SCFH flow of nitrogen stream containing 0.5% (5,000 ppm) oxygen was deoxygenated with natural gas following the procedure described in U.S. patent application Ser. No. 07/995,624. Specifically, the nitrogen stream was pre-heated to about 320° C., mixed with 0.25% natural gas (containing predominately methane) and deoxygenated by passing through a 3" diameter reactor packed with either 0.5% palladium metal catalyst supported on alumina pellets or 0.5% platinum plus palladium metal catalyst supported on a metallic honeycomb structure with a cell density of 200 cells per square inch. The catalyst was supplied by Johnson Matthey of Wayne, Pa. The amount of natural gas used was equal to the, stoichiometric amount required to convert oxygen completely to a mixture of moisture and carbon dioxide. The hourly flow rate of nitrogen stream through the reactor was 4,750 times the volume of the reactor (Gas Hourly Space Velocity or GHSV of 4,750 l/h), as shown in Table 3. The reactor effluent contained more than 1,000 ppm oxygen (see Table 3). This example showed that feed nitrogen needs to be pre-heated to more than 320° C. to reduce oxygen level below 10 ppm with stoichiometric amount of natural gas in the presence of a platinum group of metal catalyst.

Example 4B

The deoxygenation experiment described in Example 4A was repeated using the same composition and flow rate nitrogen, gas pre-heat temperature, and type of catalyst with the exception of using 0.5% natural gas instead of 0.25%. The amount of natural gas used was two times the stoichiometric amount required to convert oxygen completely to a mixture of moisture and carbon dioxide. The reactor effluent gas contained less than 5 ppm oxygen. Additionally, it contained 0.50% moisture, 0.25% carbon dioxide, and 0.25% unreacted natural gas (or methane). This example showed that feed nitrogen needs to pre-heated to about 320° C. to reduce oxygen level below 10 ppm with two times the stoichiometric amount of natural gas in the presence of a platinum group of metal catalyst.

Example 4C

The deoxygenation experiment described in Example 4A was repeated using the same flow rate nitrogen, gas pre-heat temperature, and type of catalyst with the exceptions of using nitrogen containing 1.0% residual oxygen and adding 1.0% natural gas, as shown in Table 3. The amount of natural gas used was two times the stoichiometric amount required to convert oxygen completely to a mixture of moisture and carbon dioxide. The reactor effluent gas contained less than 5 ppm oxygen. Additionally, it contained 1.0% moisture, 0.50% carbon dioxide, and 0.50% unreacted natural gas (or methane). This example showed that feed nitrogen needs to pre-heated to about 320° C. to reduce oxygen level below 10 ppm with two times the stoichiometric amount of natural gas in the presence of a platinum group of metal catalyst.

Example 4D

The deoxygenation experiment described in Example 4A was repeated using the same composition and flow rate nitrogen, gas pre-heat temperature, and type of catalyst with the exception of using 1.0% natural gas. The amount of natural gas used was four times the stoichiometric amount required to convert oxygen completely to a mixture of moisture and carbon dioxide. The reactor effluent gas contained less than 5 ppm oxygen. Additionally, it contained 0.50% moisture, 0.25% carbon dioxide, and 0.75% unreacted natural gas (or methane). This example showed that feed nitrogen needs to be pre-heated to about 320° C. to reduce oxygen level below 10 ppm with more than two times the stoichiometric amount of natural gas in the presence of a platinum group of metal catalyst.

Table 4 summarizes a series of tests wherein carbon steel specimens were annealed in non-cryogenically generated nitrogen-based atmosphere to produce an oxide on the surface of the annealed sample.

TABLE 4

| | Example 5A | Example 5B | Example 5C |
|---|---|---|---|
| Annealing Temp., °C. | 750 | 750 | 750 |
| Type of Specimens | Carbon Steels | Carbon Steels | Carbon Steels |
| Feed Gas Composition to the Furnace | | | |
| Oxygen, ppm | <5 | <5 | <5 |
| Moisture, % | 0.50 | 1.0 | 0.50 |
| Carbon Dioxide, % | 0.25 | 0.50 | 0.25 |
| Methane, % | 0.25 | 0.50 | 0.75 |
| Nitrogen | Balance | Balance | Balance |
| $pH_2/pH_2O$ in Furnace Atmosphere | <1.0 | <1.0 | <1.0 |
| Quality of Treated Specimens | Light Gray Oxide | Light Gray Oxide | Light Gray Oxide |
| Flat Specimens Decarburization Depth, in. | 0.008 | 0.008 | 0.008 |
| Carbon Content in Treated Electrical Steel Specimens, % | 0.009 | 0.010 | 0.010 |

Example 5A

The reactor effluent stream from Example 4B containing 0.50% moisture, 0.25% carbon dioxide, 0.25% unreacted natural gas (or methane), less than 5 ppm oxygen, and balance nitrogen was introduced into the heating or transition zone of the furnace operated at 750° C. to anneal carbon steel specimens.

The carbon steel specimens were annealed with a light gray oxide surface finish due to the presence of oxidizing atmosphere (or $pH_2/pH_2O$ ratio of less than 1.0) in the heating and cooling zones of the furnace. The flat specimens showed a decarburization depth of 0.008 inch. The total carbon content of the electrical steel specimens decreased from 0.018% to 0.009%. This example showed that the nitrogen-based atmosphere produced by deoxygenating non-cryogenically generated nitrogen with two times the stoichiometric amount of natural gas can be used to provide limited decarburization of carbon steels at 750° C.

Example 5B

The reactor effluent stream from Example 4C containing 1.0% moisture, 0.50% carbon dioxide, 0.50% unreacted natural gas (or methane), less than 5 ppm oxygen and balance nitrogen was introduced into the heating or transition zone of the furnace operated at 750° C. to anneal carbon steel specimens.

The carbon steel specimens were annealed with a light gray oxide surface finish due to the presence of oxidizing atmosphere (or $pH_2/pH_2O$ ratio of least than 1.0) in the heating and cooling zones of the furnace. The flat specimens showed a decarburization depth of 0.008 inch. The total carbon content of the electrical steel specimens decreased from 0.018% to 0.010%. This example also showed that the nitrogen-based atmosphere produced by deoxygenating non-cryogenically generated nitrogen with two times the stoichiometric amount of natural gas can be used to provide limited decarburization of carbon steels at 750° C.

Example 5C

The reactor effluent stream from Example 4D containing 0.50% moisture, 0.25% carbon dioxide, 0.75% unreacted natural gas (or methane), less than 5 ppm oxygen and balance nitrogen was introduced into the heating or transition zone of the furnace operated at 750° C. to anneal carbon steel specimens.

The carbon steel specimens were annealed with a light gray oxide surface finish due to the presence of oxidizing atmosphere (or $pH_2/pH_2O$ ratio of less than 1.0) in the heating and cooling zones of the furnace. The flat specimens showed a decarburization depth of 0.008 inch. The total carbon content of the electrical steel specimens decreased from 0.018% to 0.010%. This example once again showed that the nitrogen-based atmosphere produced by deoxygenating non-cryogenically generated nitrogen with four times the stoichiometric amount of natural gas can be used to provide limited decarburization of carbon steels at 750° C.

Table 5 summarizes a series of tests relating to annealing of carbon steels in non-cryogenically produced nitrogen according to the present invention.

TABLE 5

| | Example 6A | Example 6B | | Example 6C | Example 6D | |
|---|---|---|---|---|---|---|
| Annealing Temp., °C. | 750 | 750 | 850 | 750 | 750 | 850 |
| Type of Specimens | Carbon Steels | Carbon Steels | | Carbon Steels | Carbon Steels | |
| Feed Gas Composition to the Furnace | | | | | | |
| Oxygen, ppm | <5 | <5 | | <5 | <5 | |
| Moisture, % | 0.50 | 0.50 | | 1.0 | 1.0 | |
| Carbon Dioxide, % | 0.25 | 0.25 | | 0.50 | 0.50 | |
| Methane, % | 0.25 | 0.25 | | 0.50 | 0.50 | |
| Nitrogen | Balance | Balance | | Balance | Balance | |
| Amount of Hydrogen Added, % | 1.0 | 2.0 | 2.0 | 2.0 | 3.0 | 3.0 |
| $pH_2/pH_2O$ Ratio in Furnace Atmosphere | 2.0 | >4 | >4 | 2.0 | >3 | >3 |
| Quality of Treated Specimens | Light Gray Oxide | Bright | Bright | Light Gray Oxide | Bright | Bright |
| Flat Specimens Decarburization Depth, in. | 0.011 | 0.012 | 0.013 | 0.012 | 0.013 | 0.013 |
| Carbon Content in Treated Electrical Steel Specimens, % | 0.007 | 0.006 | 0.005 | 0.006 | 0.006 | 0.005 |

Example 6A

The reactor effluent stream from Example 4B containing 0.50% moisture, 0.25% carbon dioxide, 0.25% unreacted natural gas (or methane), less than 5 ppm oxygen and balance nitrogen was mixed with 1.0% hydrogen and introduced into the heating or transition zone of the furnace operated at 750° C. to anneal carbon steel specimens.

The carbon steel specimens were annealed with a light gray oxide surface finish due to the presence of an oxidizing atmosphere (or $pH_2/pH_2O$ ratio of less than 3.0) in the cooling zone of the furnace. The flat specimens showed a decarburization depth of 0.011 inch due to the presence of a reducing atmosphere (or $pH_2/pH_2O$ ratio of 2.0) in the heating zone of the furnace. The total carbon content of the electrical steel specimens decreased from 0.018% to 0.007%. This example showed that the amount of hydrogen added to the nitrogen-based atmosphere produced by deoxygenating non-cryogenically generated nitrogen with two times the stoichiometric amount of natural gas was just enough to decarburize anneal carbon steels. It was however not high enough to decarburize anneal carbon steels with a bright surface finish.

Example 6B

The reactor effluent stream from Example 4B containing 0.50% moisture, 0.25% carbon dioxide, 0.25% unreacted natural gas (or methane), less than 5 ppm oxygen and balance nitrogen was mixed with 2.0% hydrogen and introduced into the heating or transition zone of the furnace operated at 750° C. and 850° C. to anneal carbon steel specimens.

The carbon steel specimens were annealed with a bright surface finish due to the presence of a reducing atmosphere (or $pH_2/pH_2O$ ratio greater than 3.0) in the heating and cooling zones of the furnace. The flat specimens treated at 750° C. showed a decarburization depth of about 0.012 inch. The total carbon content of the electrical steel specimens treated at 750° C. was about 0.006%. The decarburization depth in the flat specimens and the total carbon content in the electrical steel specimens increased slightly with an increase in the annealing temperature. This example showed that the amount of hydrogen added to the nitrogen-based atmosphere produced by deoxygenating non-cryogenically generated nitrogen with two times the stoichiometric amount of natural gas was high enough to bright, decarburize anneal carbon steels.

Example 6C

The reactor effluent stream from Example 4C containing 1.0% moisture, 0.50% carbon dioxide, 0.50% unreacted natural gas (or methane), less than 5 ppm oxygen and balance nitrogen was mixed with 2.0% hydrogen and introduced into the heating or transition zone of the furnace operated at 750° C. to anneal carbon steel specimens.

The carbon steel specimens were annealed with a light gray oxide surface finish due to the presence of an oxidizing atmosphere (or $pH_2/pH_2O$ ratio of less than 3.0) in the cooling zone of the furnace. The flat specimens showed a decarburization depth of 0.012 inch. The total carbon content of the electrical steel specimens decreased from 0.018% to 0.006%. This example showed that the amount of hydrogen added to the nitrogen-based atmosphere produced by deoxygenating non-cryogenically generated nitrogen with two times the stoichiometric amount of natural gas was just enough to decarburize anneal carbon steels. It was however not high enough to decarburize anneal carbon steels with a bright surface finish.

Example 6D

The reactor effluent stream from Example 4C containing 1.0% moisture, 0.50% carbon dioxide, 0.50% unreacted natural gas (or methane), less than 5 ppm oxygen and balance nitrogen was mixed with 3.0% hydrogen and introduced into the heating or transition zone of the furnace operated at 750° C. and 850° C. to anneal carbon steel specimens.

The carbon steel specimens were annealed with a bright surface finish due to the presence of a reducing atmosphere (or $pH_2/pH_2O$ ratio greater than 3.0) in the heating and cooling zones of the furnace. The flat specimens treated at 750° C. showed a decarburization depth of about 0.013 inch. The total carbon content of the electrical steel specimens treated at 750° C. was about 0.006%. The decarburization depth in the flat specimens and the total carbon content in the electrical steel specimens increased marginally with an increase in the annealing temperature, as shown in Table 5. This example showed that the amount of hydrogen added to the nitrogen-based atmosphere produced by deoxygenating non-cryogenically generated nitrogen with two times the stoichiometric amount of natural gas was high enough to bright, decarburize anneal carbon steels.

DISCUSSION

The Examples 6B and 6D revealed that carbon steel samples can be bright, decarburize annealed in atmospheres produced by deoxygenating non-cryogenically generated nitrogen containing 0.5 and 1.0% residual oxygen with a hydrocarbon gas and using only 2.0 and 3% hydrogen, respectively. On the contrary, the amount of hydrogen required for a pure hydrogen-based process to produce the desired bright, decarburize annealing atmosphere from non-cryogenically generated nitrogen containing 0.5 and 1.0% residual oxygen is 4 and 8.0%, respectively (see Examples 3B and 3D). The present process therefore provides a significant savings in the amount of hydrogen required for producing decarburize annealing atmospheres from non-cryogenically generated nitrogen.

Having thus described our invention, what is desired to be secured by Letters Patent of the United States is set forth in the appended claims.

We claim:

1. A method for producing an atmosphere inside a furnace maintained at a temperature for decarburized annealing carbon steels, comprising the steps of:

pre-heating non-cryogenically produced nitrogen gas containing between 0.2 and 2% by volume residual oxygen to a temperature of at least 200° C.;

mixing said pre-heated non-cryogenically produced nitrogen with more than a stoichiometric amount of a hydrocarbon gas required to convert oxygen in said nitrogen to a mixture of moisture and carbon dioxide;

passing said mixture through a bed of precious metal catalyst for conversion of said oxygen to form an effluent gas containing nitrogen, unreacted hydrocarbon gas, moisture, carbon dioxide, and less than 10 ppm oxygen;

mixing said effluent with hydrogen in an amount to provide a $pH_2/pH_2O$ of at least 2 inside said furnace when said effluent mixed with hydrogen is introduced into said furnace.

2. A method according to claim 1 wherein said hydrocarbon gas is selected from the group consisting of alkanes, alkenes and mixtures thereof.

3. A method according to claim 1 wherein said hydrocarbon gas is selected from the group consisting of methane, ethane, propane, butane, ethylene, propylene, butene and mixtures thereof.

4. A method according to claim 1 wherein the non-cryogenically produced nitrogen is pre-heated to a temperature between 200° C. and 400° C.

5. A method according to claim 4 wherein the non-cryogenically produced nitrogen is preheated to a temperature between 225° C. and 350° C.

6. A method according to claim 1 wherein said furnace is heated to a temperature of at least 700° C.

7. A method according to claim 1 wherein the nitrogen contains between 0.25 and 1.5% by volume oxygen.

8. A method according to claim 1 wherein the nitrogen contains between 0. 5 and 1.0% by volume oxygen.

9. A method according to claim 1 where no more than 2.5 times the stoichiometric amount of hydrocarbon gas is mixed with said non-cryogenically produced nitrogen.

10. A method according to claim 1 wherein said hydrogen is added to said effluent so that said $pH_2/pH_2O$ ratio in said furnace atmosphere produces a bright surface on said annealed carbon steel.

11. A method according to claim 1 wherein said hydrogen is added to said effluent so that said $pH_2/pH_2O$ ratio in said furnace atmosphere produces an oxide surface on said annealed carbon steel.

12. A method according to claim 1 wherein said effluent is introduced into said heating and cooling zones of a continuous furnace.

13. A method according to claim 1 where said effluent is introduced into said heating and cooling zones of a furnace with the $pH_2/pH_2O$ ratio necessary to bright anneal decarburized carbon steels.

14. A method according to claim 1 wherein said effluent gas is introduced into the heating and cooling zones of said furnace and steam is introduced into said cooling zone to produce a decarburized carbon steel with an oxide coating on the surface after annealing.

* * * * *